US008672021B2

(12) United States Patent
Montestruc, III

(10) Patent No.: US 8,672,021 B2
(45) Date of Patent: Mar. 18, 2014

(54) SIMPLIFIED FLOW SHELL AND TUBE TYPE HEAT EXCHANGER FOR TRANSFER LINE EXCHANGERS AND LIKE APPLICATIONS

(76) Inventor: Alfred N. Montestruc, III, Houston, TX (US)

( * ) Notice: Subject to any disclaimer, the term of this patent is extended or adjusted under 35 U.S.C. 154(b) by 1071 days.

(21) Appl. No.: 12/658,659

(22) Filed: Feb. 12, 2010

(65) Prior Publication Data

US 2012/0205082 A1 Aug. 16, 2012

(51) Int. Cl.
*F28D 7/12* (2006.01)

(52) U.S. Cl.
USPC ..... 165/134.1; 165/142; 165/158; 165/160; 165/178

(58) Field of Classification Search
USPC ..... 165/134.1, 142, 178, 70, 158, 160
See application file for complete search history.

(56) References Cited

U.S. PATENT DOCUMENTS 3,144,080 A 8/1964 Vollhard
3,348,610 A 10/1967 Vollhard
3,610,329 A * 10/1971 Markert et al. ..... 165/134.1
3,945,431 A * 3/1976 Straub ..... 165/158
4,182,407 A * 1/1980 Lagerwerf et al. ..... 165/70
4,336,770 A * 6/1982 Kaneko et al. ..... 165/134.1
4,770,239 A * 9/1988 Duponteil ..... 165/134.1
4,848,449 A * 7/1989 Brucher et al. ..... 165/160
4,858,684 A 8/1989 Brucher et al.
5,035,283 A 7/1991 Brucher et al.
5,570,741 A * 11/1996 Brucher et al. ..... 165/134.1
5,671,807 A * 9/1997 Lameris ..... 165/134.1

FOREIGN PATENT DOCUMENTS

FR 2287668 A * 6/1976
JP 61190286 A * 8/1986

* cited by examiner

*Primary Examiner* — John Ford

(57) ABSTRACT

A shell and tube heat exchanger (which can be a boiler) which includes a plenum chamber defined by at least one of the tube-sheets and a diaphragm plate. In this plenum chamber a system of outer and inner annuli around each of the tubes created by a system of baffle tubes that surround each fluid tube and a holes in the thick tube-sheet of the exchanger. This arrangement allows the high pressure cooling fluid in the shell to keep the high temperature low pressure fluid tube inlet, and the associated tube-sheet cool under very high hot fluid flow rates at lower cost, smaller footprint and with lower pressure loss of the low pressure hot fluid than previous art.

8 Claims, 4 Drawing Sheets

SIMPLIFIED FLOW SHELL AND TUBE TYPE HEAT EXCHANGER FOR TRANSFER LINE EXCHANGERS AND LIKE APPLICATIONS

BACKGROUND OF THE INVENTION

1. Field of the Invention

The specific technical challenge this invention is intended to address is to rapidly cool or quench thermally cracked hydrocarbon gasses to allow the production of olefins (or like desired products) which are a desired product used in the production of many other chemicals in an economical manner. Slower cooling of the cracked gasses produces more waste products, and rapid cooling of the cracked gas by injection of water droplets into the cracked gas stream wastes the heat of the gas and makes more difficult (due to dilution) the removal of the desired product from the cooled gas stream. Currently the shell and tube heat exchangers discussed in below referenced patents are used in industry to cool the cracked gas along with other competing non-shell and tube exchanger designs not of interest to this application, and injection of water droplets in some older facilities. In addition to the desire to cool the cracked gasses rapidly, it is desirable to not cool the cracked gasses below specific values that are well above the boiling point of water at atmospheric pressures, and to maximize energy recovery. The design pressure of the cooling fluid, typically water in the heat exchanger will usually be over 50 barr. This creates difficulties in pressure containment of the cooling fluid in the exchanger that work in opposition to the goal of rapid quench of the cracked gasses. The requirement of rapid cooling of the cracked gasses tends to make a thin layer of metal of the heat exchanger between the cracked gas and cooling fluid desirable such that the film coefficient of boiling of the cooling fluid will dominate the heat transfer such that the metal will stay cool. However, the additional constraint of containing the pressure of the cooling fluid in the exchanger tends to force the shell and especially the tube-sheet of a conventional design shell and tube exchanger to be quite thick, were a conventional shell and tube design used.

2. Prior Art

Vollhard in his 1964 patent (U.S. Pat. No. 3,144,080) teaches a heat exchanger primarily for the purpose of quench cooling thermally cracked hydrocarbon gasses to allow the production of olefins.

The heat exchanger of this patent, rather than using a conventional shell and tube design, uses a bundle of individual tube in tube heat exchangers in arrangements where the cracked gas passes through the inner tube, and the annular portion has water and steam to cool the cracked gas. These annular volumes are manifolded together in patterns shown in that work to use common water inlet tubes and common steam and water outlet tubes. In a later 1967 patent Vollhardt (U.S. Pat. No. 3,348,610) teaches how to make a shell and tube heat exchanger for the same (quench cooling of thermally cracked hydrocarbon gasses to allow the production of olefins.) purpose.

To the knowledge of the inventor this latter design has not been very commercially successful while variations of the former have been very successful. However the former design is expensive in that it requires a great many welds and is rather large in volume for the effective amount of heat exchange area created.

Brucher & Lachmann teach a method to solve the problem of use of a shell and tube heat exchanger in this application by suspending a thin tube-sheet from a thick structural tube-sheet either by structural members called slabs in their 1989 patent (U.S. Pat. No. 4,858,684) or webs in their 1991 patent (U.S. Pat. No. 5,035,283) This basic design in practice restricts the shell and tube exchanger designer to a rectangular arrangement of tubes which is less than ideal in efficient use of space and requires the addition of a second thick shell wall shown in FIG. 1 of their 1991 patent and FIG. 1 of their 1989 patent (item 10 in that patent). These restrictions raise the cost of fabrication of the heat exchanger designed for a given heat load over what might be achieved in less demanding service, however the expense and ratio of heat exchanger area per unit volume tends to be superior to that of the tube in tube Vollhard design of the 1964 patent, and are commercially successful. All of these designs in general use enhanced natural circulation which takes advantage of the difference in density of the cooling fluid in pure liquid phase coming down from a steam drum in down-corner pipe(s) and a mixture of both liquid and vapor phase cooling fluid rising in the riser(s) from the exchanger to the steam-drum. Other means may be used but this is the most common. The pressure difference induced by natural circulation is small, typically significantly less than a barr.

SUMMARY OF THE INVENTION

The present invention provides an improvement over the current state of the art of heat exchanger design for production of olefins, and other applications. This improvement is of the form that the present invention allows denser packing of the heat exchanger tube bundle may be used as hexagonal tube arrangements may be used, which is not possible with either the Vollhardt or Brucher & Lachmann designs. Further the expensive and space consuming second outer thick steel shell required by the inventions taught by Brucher & Lachmann are not required with this design.

BRIEF DESCRIPTION OF THE DRAWINGS

For a proper understanding of the current invention, reference should be made to the following detailed description taken in conjunction with the accompanying drawings, in which like parts are given like reference numerals, and wherein.

DETAILED DESCRIPTION OF THE INVENTION

Figure 1:
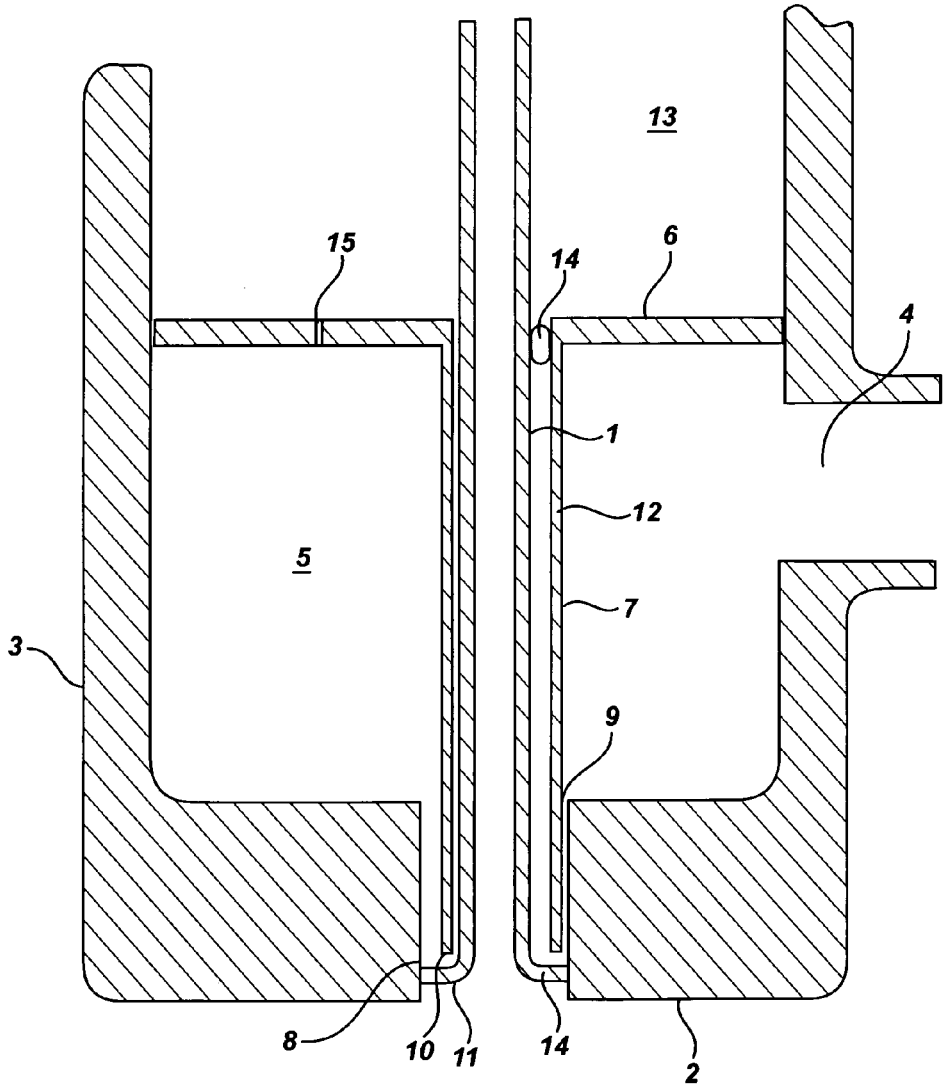
FIG. 1 is a horizontal section view of the present invention showing only one heat exchanger tube for clarity. The section is taken longitudinally, and should be considered to be half-way through; the exchanger showing only the lower half, and half-way through the tube shown, and half-way through the water inlet.
Figure 2:
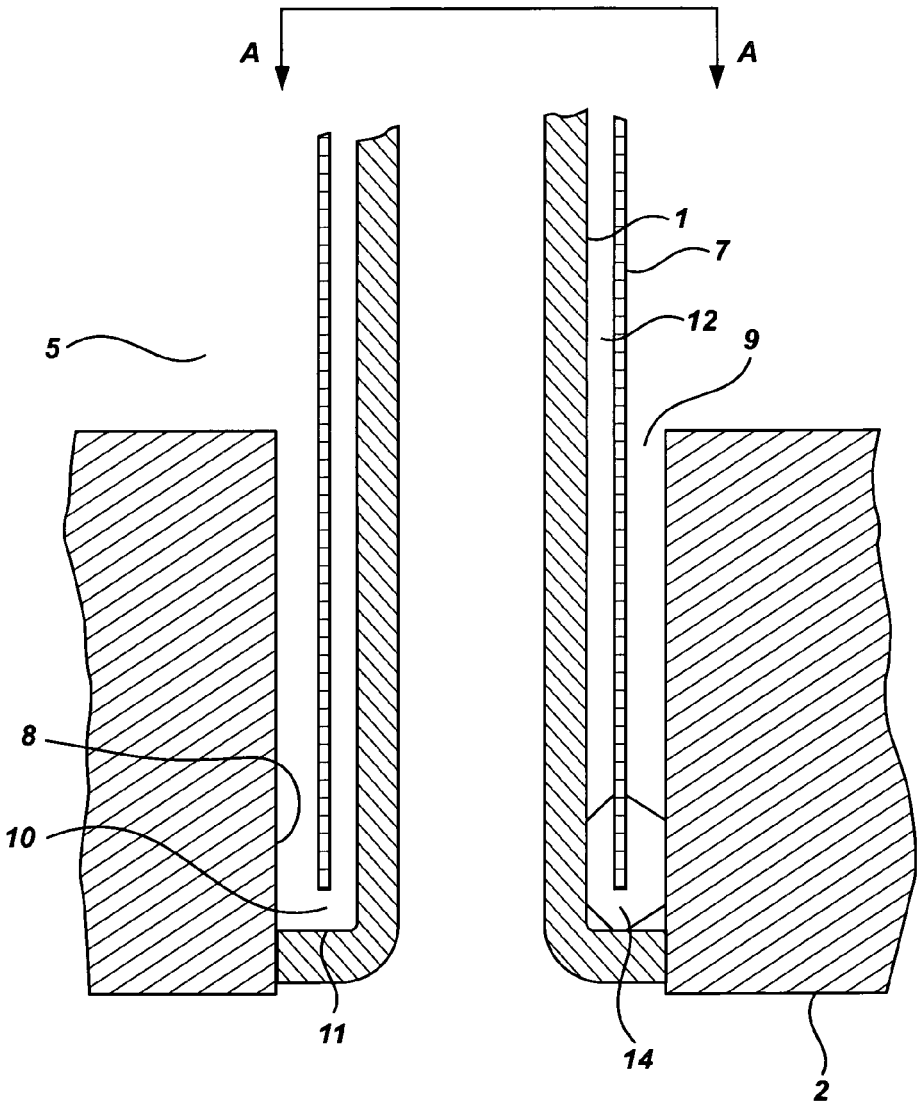
FIG. 2 is a horizontal section view of the same section as FIG. 1 but shows a close-up and more detailed view of the region of the lower tube-sheet on a simpler embodiment of this invention and indicates the view position of a vertical section A-A shown in FIG. 3.
Figure 3:
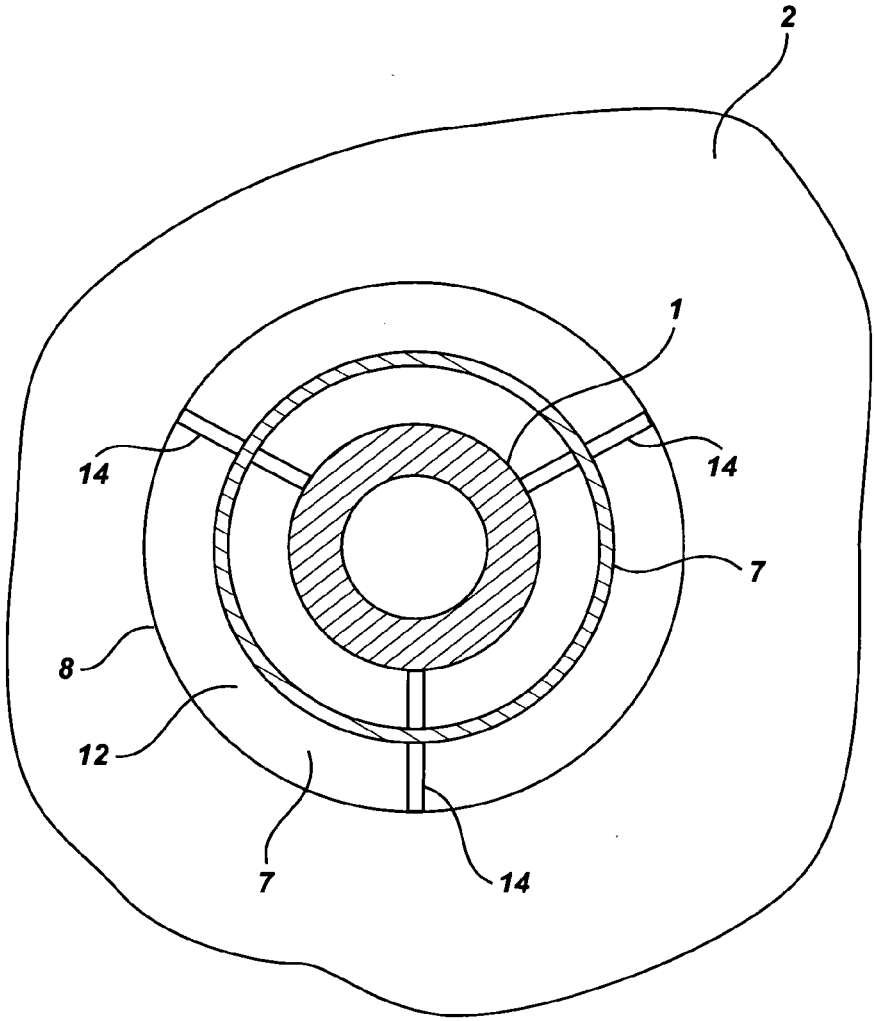
FIG. 3 is that section indicated in FIG. 2 and shows the relative arrangement of the assembled heat exchanger tube, baffle tube and the hole in the tube-sheet, and the spacer tabs.
Figure 4:
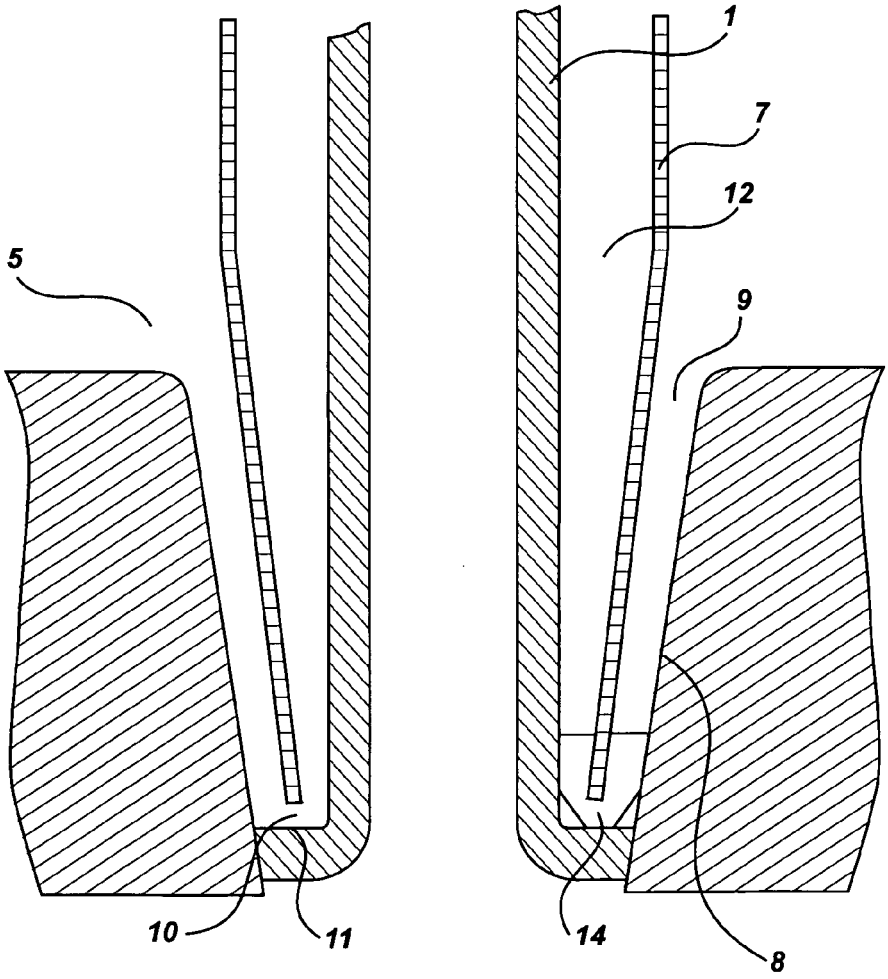
FIG. 4 is a horizontal section view of the same section as FIG. 1 but shows a close-up and more detailed view of the lower tube-sheet for the more complex and preferred embodiment of this invention where the baffle tube near the tube-sheet and the hole in the tube-sheet are both tapered to allow reduction in resistance to flow of water and steam and so allow higher heat flux and so more rapid and efficient quench of the product.

The current invention is a shell and tube heat exchanger intended primarily for use to rapidly cool or quench thermally cracked hydrocarbon gasses to allow the production of olefins, it may however be used for other purposes. It may be assumed that where not otherwise specified, standard practice for manufacture of shell and tube heat exchangers may be used. The invention in the fundamental embodiment is shown in detail in FIGS. 1 through 3, a variation showing the preferred embodiment is shown in FIG. 4. In the primary application the intent is 5 that the cracked gasses will flow up through the fluid tubes (item 1). The exchanger in this application will be oriented such that the fluid inlet is on the bottom of the exchanger. At the inlet of these tubes, it is necessary to provide cooling for the excess heat flux due to the high fluid flow rates, high inlet temperature, and higher heat flux due of the turbulence of the gas side inlet disturbance. The pressure must also be contained by the thick tube-sheet (item 2) and the shell of the exchanger (item 3). To accomplish this, a cooling fluid, typically water, flows into one or more inlets (item 4) into the plenum chamber (item 5), through which a plurality of thick walled fluid tubes (1), are arrayed parallel to each other in either a rectangular or hexagonal pattern each perpendicular to, and typically welded to the tube-sheets (2) on either end of the shell (3). The tube-sheet on the upper side of the present invention may be of conventional design. In the current invention the plenum chamber (5) is divided from the rest of the inside of the shell by a diaphragm plate (item 6) to which are fixed baffle tubes (item 7), one of which surrounds each fluid tube from the diaphragm plate (6), down and into a hole (item 8) cut into the tube-sheet (2) for the purpose of cooling the tube-sheet (2). The cooling fluid flows from the plenum chamber (4) into the annular space (item 9) formed between inside surface of the hole (8) and outside surface of the baffle tube (7), the tip of the baffle tube (7) is kept at a precise gap (item 10) from the bottom (item 11) of the hole where the fluid tubes (5) are welded to the tube-sheet (1). The cooling fluid in the annulus (9) flows through the gap (10) and then into the inner annulus (item 12) where the cooling fluid then proceeds up that inner annulus out past the diaphragm plate (6) and into the Main internal chamber (item 13) of the heat exchanger. The baffle tubes (7) are held in precise alignment with the fluid tubes (1) and the holes in the tube-sheet (8) by means of a plurality of tabs (item 14) (not less than three per tube at each elevation so fixed) affixed to each baffle tube (7) between it and the inner fluid tube (1) and edge of the hole in the tube-sheet (8). The baffle tubes are also fixed to the diaphragm plate (6) by any of several means. The baffle tubes (7) and tabs (14) should be installed prior to the fluid tubes (1) and may be used to aid in fabrication of the heat exchanger. In addition a plurality of vent holes (item 15) are cut in to the diaphragm plate (6) to allow venting of any gasses or vapors that may exist in the plenum chamber and are prevented from exiting via the primary annular passages by buoyancy. These vent holes (15) should be in total cross-sectional area much smaller than the summation of the areas of gaps (10) to assure rapid flow of the cooling fluid where it is needed.

A preferred embodiment of the present invention is shown in FIG. 4. In this embodiment both the holes (8) in the tube-sheet (2), and a portion of the baffle tube (7) in and near those holes (8) are tapered such that the hole (8) opening is larger on the inside of the tube-sheet (2), and likewise the area of the annular opening (12) between the fluid tube (1) and baffle tube (7) is at a minimum at the bottom edge of that tube by the gap (10) and opens up to some larger value selected by the designer at some elevation above the gap also selected by the designer. The reason this is desirable is that the fluid used most commonly used, water and other fluids that might also be used change from liquid to gas phase as heat is added. Recall that commonly the standard means of inducing flow for these types of heat exchangers is to use enhanced natural circulation, which takes advantage of the expansion in volume. As a consequence with a straight un-tapered system, the expansion in volume along the inner annulus can result in much reduced flow of cooling fluid for one tube relative to others if the gas flow is higher in that tube. This in turn can lead to overheating and possible failure of the tubes, welds, or tube-sheet itself. The tapered design will expand the flow area as heat is added to the flow, and so the volumetric flow rate can be held more constant, and in fact further enhancement of flow in an over heated tube can be had by a chimney effect of the lower density of the fluid in the inner annulus relative to the density of the fluid in the plenum chamber and outer annulus.

PARTS LIST

| Part Number | Description |
|---|---|
| 1 | fluid tube |
| 2 | tube-sheet |
| 3 | shell |
| 4 | cooling fluid inlet |
| 5 | plenum chamber |
| 6 | diaphragm plate |
| 7 | baffle tube |
| 8 | tube hole in tube-sheet |
| 9 | plenum to gap annulus |
| 10 | gap between end of baffle tube and hole bottom |
| 11 | hole bottom |
| 12 | baffle tube to fluid tube annulus |
| 13 | main exchanger chamber |
| 14 | spacer tabs to hold position of baffle tubes |
| 15 | vent hole in diaphragm plate |

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and in a limiting sense.

What is claimed in this invention is:

1. A shell and tube heat exchanger comprising;

a) a plurality of tubes through which a hotter, lower pressure fluid intended to be cooled flows, said tubes are surrounded by cooling fluid under high pressure, which pressure is contained in principally tensile and bending stress by an external shell, and by said tubes in principally compressive stress, b) said external shell is made of a large substantially cylindrical shaped structure joined and sealed to two substantially flat round disk shaped tube-sheets on either end of the large substantially cylindrical shaped structure, c) the wall thickness of said large substantially cylindrical shaped shell structure is substantially larger than that of the tube walls, and the wall thickness of the round disk shaped tube-sheet structure is substantially larger than the thickness of the tube wall and the thickness of the substantially cylindrical shaped shell structure, d) said tubes extend from one tube-sheet to the other parallel to the axis of the outer cylindrical shaped shell structure, said tubes are directly joined and sealed on either end to said tube-sheets toward the outer side of each tube-sheet, but are located completely within a plane defined by a substantially flat outside facing surface of the tube-sheet, e) said shell and tube heat exchanger has at least one cooling fluid inlet leading to at least one plenum chamber for said cooling fluid, said at least one plenum chamber is adjacent to a respective one of the tube-sheets, and said at least one plenum chamber is segregated from the rest of the cooling fluid in a main interior chamber of the heat exchanger by a diaphragm plate, and further comprising at least one cooling fluid outlet from the main interior chamber of the heat exchanger, f) within said at least one plenum chamber said tubes are each surrounded by a baffle tube, which baffle tube is sealed on one end to the diaphragm plate, and projects outward through the plenum chamber into tube-holes in the tube-sheet on the other end thereof to form a specified gap between the end of the baffle tube and hole bottom where the tube is joined to the tube-sheet, g) wherein tube-holes cut into the tube-sheet form two annular gaps between each tube and the tube-sheet, the cooling fluid flow path being divided by said baffle tubes into an inner annular gap between the tubes and baffle tubes, and an outer annular gap between the baffle tube and tube-hole cut into the tube-sheet and the end of each tube extends across the inner annular gap and the outer annular gap and is joined to a sidewall of the tube-hole, h) the cooling fluid flows from the plenum chamber inlet, into the plenum chamber, then, into each of the outer annular gaps for each tube, then, for each tube, down toward the tube to tube-sheet joint, and then up the inner annular gap up to and through the diaphragm plate to the main interior chamber of the heat exchanger, i) which said baffle tube is held in position relative to the tube and tube hole in the tube-sheet, and the hole bottom, by a plurality of tabs arranged proximate to said specified gap and so arranged as to allow even flow around the circumference of each annulus.

2. The heat exchanger of claim 1 wherein at least one vent between the at least one plenum chamber and main exchanger chamber through the diaphragm plate or shell exists.

3. The heat exchanger of claim 1 wherein at least some portion of the at least one of the baffle tubes or any or the tube holes in the tube-sheets is tapered so as to have high flow speed of the cooling fluid at the tube to tube-sheet joints for that tube to effect better heat transfer at this high heat load point in said tubes.

4. The heat exchanger of claim 3 wherein at least one vent between the at least one plenum chamber and main exchanger chamber through the diaphragm plate or shell exists.

5. The heat exchanger of claim 1 where the relative position of the tube and baffle tube are held by tabs substantially at the location along the tube where the tube passes through the diaphragm plate, and the baffle tube is mounted to the diaphragm plate.

6. A shell and tube heat exchanger comprising;

a) a plurality of tubes through which a hotter, lower pressure fluid intended to be cooled flows, said tubes are surrounded by cooling fluid under high pressure, which pressure is contained in principally tensile and bending stress by an external shell, and by said tubes in principally compressive stress, b) said external shell is made of a large substantially cylindrical shaped structure joined and sealed to two substantially flat round disk shaped tube-sheets on either end of the large substantially cylindrical shaped structure, c) the wall thickness of said large substantially cylindrical shaped shell structure is substantially larger than that of the tube walls, and the wall thickness of the round disk shaped tube-sheet structure is substantially larger than the thickness of the tube wall and the thickness of the substantially cylindrical shaped shell structure, d) said tubes extend from one tube-sheet to the other parallel to the axis of the outer cylindrical shaped shell structure, said tubes are directly joined and sealed on either end to said tube-sheets toward the outer side of each tube-sheet, but are located completely within a plane defined by a substantially flat outside facing surface of the tube-sheet, e) said shell and tube heat exchanger has at least one cooling fluid inlet leading to at least one plenum chamber for said cooling fluid, said at least one plenum chamber is adjacent to a respective one of the tube-sheets, and said at least one plenum chamber is segregated from the rest of the cooling fluid in a main interior chamber of the heat exchanger by a diaphragm plate, and further comprising at least one cooling fluid outlet from the main interior chamber of the heat exchanger, f) wherein within said at least one plenum chamber said tubes are each surrounded by a baffle tube, which baffle tube is sealed on one end to the diaphragm plate, said baffle tubes are straight for the length from the diaphragm plate to a tube-hole in the tube-sheet, then tapered over the length that goes into the tube-hole in the tube-sheet, facilitating high cooling fluid flow speed at the tube to tube-sheet joint, which in turn facilitates better cooling of the tube to tube-sheet joint that normally sees high thermal loading, g) wherein tapered tube-holes cut into the tube-sheet form two annular gaps between each tube and tube-hole in the tube-sheet, said tapered tube-hole further facilitates high cooling fluid flow speed at the tube to tube-sheet joint, and so better cooling of that joint that normally sees high thermal loading, h) where each baffle tube extends from the diaphragm plate to which it is sealed, across the plenum chamber and then into the tube hole in the tube-sheet, then down in that hole to a specified gap between end of baffle tube and hole bottom where the tube is joined to the tube-sheet, and forms two annular gaps, the first between the tube and baffle tube, the second between the baffle tube and tube-holes cut into the tube-sheet, the cross-sectional area of the first annular gap between the tube and the baffle tube increases along the length of the tube in a direction away from the specified gap, and i) wherein which said baffle tube is held in position relative to the tube and tube hole in the tube-sheet, and the hole bottom, by a plurality of tabs so arranged to allow even flow around the circumference of each annulus.

7. The heat exchanger of claim 6 wherein at least one vent between the at least one plenum chamber and main exchanger chamber through the diaphragm plate or shell exists.

8. The heat exchanger of claim 6 where the relative position of the tube and baffle tube are held by tabs substantially at the location along the tube where the tube passes through the diaphragm plate, and the baffle tube is mounted to the diaphragm plate.

* * * * *